United States Patent [19]

Anderson et al.

[11] 4,391,681

[45] Jul. 5, 1983

[54] METHOD OF INHIBITING FORMATION OF AND BREAKING OF MERCURY BUTTER IN CHLOR-ALKALI CELLS

[75] Inventors: Susan Anderson, Lightwater; David E. Brown, Weybridge; David E. Graham, Fleet; Mahmood N. Mahmood, Walton-on-Thames; Maurice C. M. Man, London, all of England

[73] Assignee: The British Petroleum Company p.l.c., London, England

[21] Appl. No.: 377,606

[22] Filed: May 13, 1982

[30] Foreign Application Priority Data

May 14, 1981 [GB] United Kingdom ..... 8114856
Mar. 19, 1982 [GB] United Kingdom ..... 8208108

[51] Int. Cl.[3] ..... C25B 1/16; C25B 1/42
[52] U.S. Cl. ..... 204/99; 204/125
[58] Field of Search ..... 204/99, 125

[56] References Cited

U.S. PATENT DOCUMENTS 3,415,727 12/1968 Hass et al. ..... 204/99
3,502,434 3/1970 MacMillan ..... 75/81
3,535,215 10/1970 Grotheer ..... 204/99
3,954,580 5/1976 Kaminsky et al. ..... 204/99

FOREIGN PATENT DOCUMENTS 1437472 5/1976 United Kingdom ..... 204/99
1462468 1/1977 United Kingdom ..... 204/99
1462830 1/1977 United Kingdom ..... 204/99

*Primary Examiner*—R. L. Andrews
*Attorney, Agent, or Firm*—Brooks, Haidt, Haffner & Delahunty

[57] ABSTRACT

The present invention relates to a method of inhibiting the formation of and/or breaking of preformed mercury butter in chlor-alkali cells. The method comprises introducing at any one of the numerous stages of the electrolytic process an aqueous solution of a surfactant material which enables the interfacial tension of the sodium-amalgam interface to be increased to or maintained above a value of 180 dynes/cm. The surfactants may be extracts of decaying vegetation, solutions of carboxylic acids or chlorohydrocarbons. Extracts containing lignite or humic acids are most effective.

11 Claims, No Drawings

METHOD OF INHIBITING FORMATION OF AND BREAKING OF MERCURY BUTTER IN CHLOR-ALKALI CELLS

The present invention relates to a method of inhibiting the formation of and breaking of mercury butter in chlor-alkali electrolytic cells which use flowing mercury cathodes.

By electrolytic cells is meant here and throughout the specification a system comprising an electrolyser and an amalgam denuder (decomposer).

In electrolytic cells used to manufacture chlorine and caustic alkali from alkali metal brines, mercury is used as a flowing cathode in the electrolyser. The cathode is continuously replenished by recycling an amalgam of substantially reduced metal content to one end of the electrolyser. At the opposite end an alkali metal rich amalgam is continuously withdrawn and reacted with water in a unit called the amalgam "denuder". This reaction converts the alkali metal in the amalgam into caustic alkali leaving an amalgam with a substantially reduced alkali metal content which is withdrawn from this unit and recirculated into the electrolyser by means of a pump. During operation, the amalgam (containing varying concentrations of alkali metal) tends to deposit a semi-solid material in various ports of the electrolyser base plate, the mercury pump etc. This semi-solid material can be in the form of a silvery white lump, which may be shiny or matt, and usually tends to stick to the electrolyser base plate. This semi-solid material, which may be either highly viscous or an immobile solid is the so-called "mercury butter". The presence of mercury butter in such electrolysers is undesirable because it gives rise to short-circuiting between the anode and the mercury cathode. It is possible to increase the brine gap to avoid short-circuiting but this results in reduced efficiency because of higher ohmic losses, leading to higher power costs. In addition, short-circuiting causes damage to the anodes and electrolyser base plate. Mercury butter can also cause damage to other components and equipment used in the process in the long term.

Various reasons have been proposed for the formation of mercury butter. These include (i) the presence of strontium in the brine being electrolysed at a concentration above a certain specified threshold (cf GB Pat. No. 1,462,468 and U.S. Pat. No. 3,954,580), (ii) the aqueous dispersions formed by small droplets of water, aqueous caustic alkali and brine which are then entrained by the amalgam (cf GB Pat. No. 1,462,830), and (iii) the presence of trace impurities in the brine electrolyte (cf GB Pat. No. 1,437,472).

The methods of preventing butter formation in the cell suggested hitherto include (a) removal of strontium from the alkali metal brine, (b) use of mechanical means consisting of rotating vanes which are positioned across the interface between the amalgam and the water to be added so as to draw water into the amalgam when the vanes are rotated, and (c) purifying the water used for converting the alkali metal rich amalgam into caustic alkali.

It has now been found that mercury butter formation may be inhibited and mercury butter already formed can be broken in such cells by using substances which are capable of favourably affecting the interfacial tension at the amalgam-aqueous interface.

Accordingly, the present invention is a method of inhibiting the formation of and/or breaking of preformed mercury butter during electrolysis of alkali metal brines to produce chlorine and caustic alkali using a flowing mercury cathode which consists essentially of the following steps (a) electrolysis of the brine in an electrolyser,
(b) removal of an alkali metal rich amalgam from the electrolyser,
(c) removal of the alkali metal from the rich amalgam in a denuder,
(d) withdrawal of the amalgam substantially reduced in alkali metal content from the denuder, and
(e) recirculation of the amalgam from step (d) into the electrolyser for step (a), characterised in that an aqueous solution of a surfactant material capable of increasing the interfacial tension of the sodium amalgam-aqueous interface to and/or maintaining the interfacial tension of the sodium amalgam-aqueous interface at a value of at least 180 dynes/cm is introduced at one or more of the above steps (a) to (e) so as to be in contact with the circulating mercury or amalgam.

The interfacial tension of the amalgam-aqueous interface is preferably increased to and/or maintained above 220 dynes/cm. The absolute levels will depend upon the precise nature of the mercury butter.

Examples of such surfactant materials include (a) aqueous extracts of decaying vegetation, eg lignin, peat, tea and coffee, (b) carboxylic acids such as humic acids, succinic acid, tartaric acid, formic acid, malic acid, malonic acid and maleic acid, and (c) halogenated hydrocarbons such as chloroform and dichloromethane. The aqueous extracts of decaying vegetation contain, amongst others organic materials such as lignite, leonardite and humic acids. Aqueous extracts of decaying vegetation comprising lignite and humic acids are particularly preferred. Aqueous extracts comprising these components may be alkaline, neutral or acidic in character.

It is preferable to introduce the extract into the denuder along with demineralised water used to convert the alkali metal in the amalgam to caustic alkali.

The amount of aqueous extract used will depend upon the nature and the amount of surfactant material in the extract. Thus dosage of aqueous extracts containing lignite and/or humic acid into the aqueous medium used for introduction into the cell is suitably such that the amount of lignite and/or humic acid is at least 1 ppm, preferably between 10 ppm and 0.1% by weight of the aqueous medium.

The surfactant materials now used not only inhibit the formation of mercury butter but are also capable of breaking mercury butter previously formed.

The present invention is further illustrated with reference to the following tests.

EXAMPLE 1

Formation of Mercury Butter

Mercury butter was produced in the laboratory as follows:

(a) Triply distilled mercury (20 ml) and 15% w/v sodium hydroxide solution (30 ml) were electrolysed for 10 minutes at a current of 2 amperes in a 100 ml Pyrex-glass measuring cylinder. The mercury was thus amalgamated with 0.106% w/w of sodium at the end of the electrolysis.

(b) The electrodes were then replaced by a stirrer. The tip of the stirrer was positioned about 1 cm above the sodium amalgam. The sodium amalgam/caustic soda mixture was stirred vigorously for 30 seconds, during which the measuring cylinder was raised up and down frequently by hand, so that the sodium amalgam was thoroughly mixed with caustic soda solution. After stirring, the volume of the sodium amalgam had increased from 20 ml to 30–40 ml. This was due to the formation of an emulsion and/or foam of the sodium amalgam as a separate phase on top of the sodium amalgam. This sodium amalgam emulsion and/or foam, commonly known as mercury butter, was stable up to 4–5 hours, after which it collapsed and returned to the original volume of 20 ml.

Inhibition of Mercury Butter Formation (c) 0.106% w/w sodium amalgam was prepared according to procedure outlined in 1(a) above. Inhibitors (shown in paragraphs 1(d) to 1(f) below) were then added to the sodium amalgam/caustic soda mixture and the resulting solutions were stirred vigorously for 30 seconds as in 1(b) above. If there was no volume change in the sodium amalgam shortly, eg 10 seconds, after the stirring, the inhibitor was considered as effective in inhibiting mercury butter formation.

(d) 1 g of causticised lignite (derived by extracting lignin with caustic soda and sold commercially as "Imco Thin") was mixed with 15% w/v caustic soda solution (200 ml). The insoluble solids amounting to 0.3 g were filtered off. Aliquots of the resultant solution (containing ca 3500 ppm of causticised lignite) were used as inhibitor in three tests described in 1(b). It was found that when applied in a water medium at approximate causticised lignite concentrations of 38 ppm, 63 ppm and 125 ppm each no mercury butter was formed.

(e) 2 g of lignite (which was not causticised and is sold commercially as "Imco-Lig") was mixed with distilled water (100 ml) and the solid particles were filtered off. The resultant solution which was assumed to contain 20,000 ppm of lignite was diluted ten times. The diluted solution (0.9 ml) was added to the sodium amalgam-sodium hydroxide mixture prepared as in 1(a) above and stirred vigorously for 30 secs. as in 1(b) above. No volume change was detected indicating that no mercury butter was formed.

(f) A tea extract was prepared by soaking a tea bag in hot distilled water (50 ml) for 1 hour. 1 ml of this extract when used as inhibitor in the test in 1(b) above showed no volume change indicating that no mercury butter was formed.

EXAMPLE 2

(a) An amalgam was produced as follows:

20 cc pure mercury was made to be the cathode in an electrolyser with a nickel mesh anode and 20% w/v sodium hydroxide as electrolyte. A current of 2 amperes was passed for 10 min to produce an amalgam concentration of 0.106% w/w. The electrodes were removed and the electrolyte replaced by distilled water (30 ml). The two-phase mixture was then stirred vigorously for 15–30 seconds. The stirrer was removed and the increase in volume of the mercury due to butter formation was noted. Samples of this amalgam were tested in vitro by the addition of humic acid as follows and the mercury butter formed monitored.

(b) Humic Acid (0.1 g) was mixed with distilled water (50 ml). Aqueous sodium hydroxide solution (5 ml, 20% w/v) was then added to complete the dissolution. 1 ml of the resulting humic acid solution which contained 1820 ppm of humic acid was then added to the sodium amalgam-water mixture in 2(a) above to give a concentration of 60 ppm of humic acid. The mixture was then stirred. No mercury butter was formed.

EXAMPLE 3

The process of Example 2 was repeated using 30 ml of a suspension of chloroform in distilled water (0.1% w/v) instead of humic acid. Mercury butter was formed initially but decomposed in less than 15 seconds.

EXAMPLE 4

The process of Example 2 was repeated using 30 ml of a solution of succinic acid in distilled water (0.1% w/v) instead of humic acid. Mercury butter was formed initially but decomposed in less than 10 minutes.

EXAMPLE 5

The process of Example 2 was repeated using 30 ml of a solution of tartaric acid [$CO_2H$—CH(OH)—CH(OH)—$CO_2H$] in distilled water (0.1% w/v). Mercury butter was formed initially but decomposed in less than 10 minutes.

We claim:

1. A method of inhibiting the formation of and/or breaking of preformed mercury butter during electrolysis of alkali metal brines to produce chlorine and caustic alkali using a flowing mercury cathode which consists essentially of the following steps (a) electrolysis of the brine in a electrolyser,
(b) removal of an alkali metal rich amalgam from the electrolyser,
(c) removal of the alkali metal from the rich amalgam in a denuder,
(d) withdrawal of the amalgam substantially reduced in alkali metal content from the denuder, and
(e) recirculation of the amalgam from step (d) into the electrolyser for step (a), characterised in that an aqueous solution of a surfactant material capable of increasing the interfacial tension of the sodium amalgam-aqueous interface to and/or maintaining the interfacial tension of the sodium amalgam-aqueous interface at a value of at least 180 dynes/cm is introduced into the amalgram denuder so as to be in contact with the circulating mercury or amalgam.

2. A method according to claim 1 wherein the aqueous solution of the surfactant material is capable of increasing the interfacial tension of the amalgam-aqueous interface to and/or maintaining said tension above a value of 220 dynes/cm.

3. A method according to claim 1 wherein the surfactant material is selected from a carboxylic acid and a halogenated hydrocarbon.

4. A method according to claim 1 wherein the surfactant material is selected from lignin, neat, tea and coffee.

5. A method according to claim 1 wherein the surfactant material comprises lignite and/or humic acid.

6. A method according to claim 3 wherein the carboxylic acid is selected from humic acids, succinic acid, tartaric acid, formic acid, malic acid, malonic acid and maleic acid.

7. A method according to claim 3 wherein the halogenated hydrocarbon is selected from chloroform and dichloromethane.

8. A method according to claim 1 or claim 5 wherein the amount of surfactant material based on the total aqueous medium introduced is at least 1 ppm.

9. A method according to claim 1 or claim 5 wherein the amount of surfactant material based on the total aqueous medium introduced is between 10 ppm and 0.1% by weight.

10. A method of inhibiting the formation of and/or breaking of preformed mercury butter during electrolysis of alkali metal brines to produce chlorine and caustic alkali using a flowing mercury cathode which consists essentially of the following steps:

(a) electrolysis of the brine in an electrolyser, (b) removal of an alkali metal rich amalgam from the electrolyser, (c) removal of the alkali metal from the rich amalgam in a denuder, (d) withdrawal of the amalgam substantially reduced in alkali metal content from the denuder, and (e) recirculation of the amalgam from step (d) into the electrolyser for step (a), characterized in that an aqueous solution containing between 10 ppm and 0.1% by weight of a surfactant material capable of increasing the interfacial tension of the sodium amalgam-aqueous interface to and/or maintaining the interfacial tension of the sodium amalgam-aqueous interface at a value of at least 180 dynes/cm is introduced at one or more of the above steps (a) to (e) so as to be in contact with the circulating mercury or amalgam.

11. A method as defined in claim 10 wherein the surfactant material comprises lignite and/or humic acid.

* * * * *

UNITED STATES PATENT AND TRADEMARK OFFICE

CERTIFICATE OF CORRECTION

PATENT NO. : 4,391,681

DATED : July 5, 1983

INVENTOR(S) : SUSAN ANDERSON, DAVID E. BROWN, DAVID E. GRAHAM, MAHMOOD N. MAHMOOD, and MAURICE C.M. MAN, It is certified that error appears in the above—identified patent and that said Letters Patent is hereby corrected as shown below:

Col. 1, line 27, "ports" should read --parts--

Claim 4, line 56, "neat" should read --peat--

Signed and Sealed this

*Twenty-ninth* Day of *May 1984*

[SEAL]

*Attest:*

GERALD J. MOSSINGHOFF

*Attesting Officer*

*Commissioner of Patents and Trademarks*